United States Patent [19]

Lange et al.

[11] 3,976,874

[45] Aug. 24, 1976

[54] IMAGE TUBE INCORPORATING A BRIGHTNESS-DEPENDENT POWER SUPPLY

[75] Inventors: Gerhard Lange; Detlef Falk, both of Bremen, Germany

[73] Assignee: U.S. Philips Corporation, New York, N.Y.

[22] Filed: Oct. 6, 1975

[21] Appl. No.: 619,775

Related U.S. Application Data

[63] Continuation of Ser. No. 478,607, June 12, 1974, abandoned.

[30] Foreign Application Priority Data

June 16, 1973 Germany ..... 2330738

[52] U.S. Cl. ..... 250/213 VT; 250/207; 307/318

[51] Int. Cl.[2] ..... H01J 31/50

[58] Field of Search ..... 250/213 VT, 207, 211 J; 307/283, 302, 318, 278; 178/DIG. 29; 315/10, 125

[56] References Cited

UNITED STATES PATENTS

| | | | |
|---|---|---|---|
| 3,076,896 | 2/1963 | Smith | 250/207 |
| 3,452,206 | 6/1969 | Biet et al. | 250/211 J |
| 3,453,435 | 7/1969 | Goetzberger | 250/211 J |
| 3,626,188 | 12/1971 | Chilton | 250/211 J |
| 3,694,659 | 9/1972 | Ramsay et al. | 250/213 VT |
| 3,739,178 | 6/1973 | Chow | 250/213 VT |
| 3,821,546 | 6/1974 | McClenahan | 250/207 |

*Primary Examiner*—Walter Stolwein
*Attorney, Agent, or Firm*—Frank R. Trifari; Ronald L. Drumheller

[57] ABSTRACT

The invention relates to a noctoviser comprising an image intensifier tube and a cascade high-voltage generator in which the intensifier tube is connected to the output of the high voltage generator via a parallel connection of a resistor and an avalanche diode.

3 Claims, 2 Drawing Figures

IMAGE TUBE INCORPORATING A BRIGHTNESS-DEPENDENT POWER SUPPLY

Figure 1:
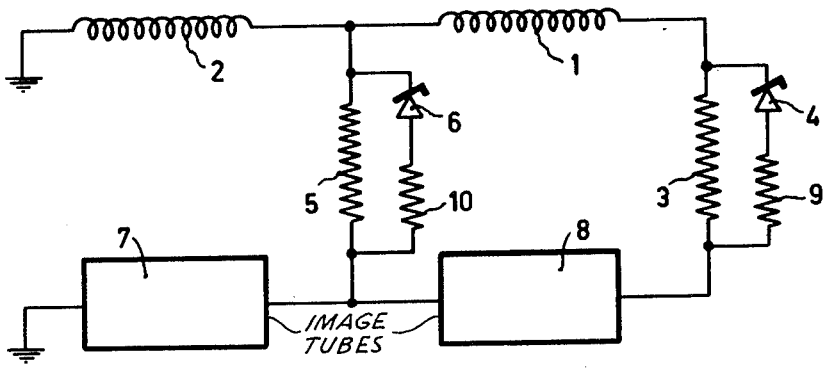

This is a continuation of application Ser. No. 478,607, filed June 12, 1974, now abandoned.

The invention relates to a noctoviser comprising an image intensifier tube and a cascade high-voltage generator.

For single-stage as well as multi-stage noctovisers comprising an image intensifier tube it is desirable that the luminescence of the screen facing the viewer or a television camera tube remains constant even though the illumination level of the scene changes.

A coarse adaptation can be achieved by using series resistors in the current circuit of the power supplies. However, this has the drawback that the apparatus is switched off at higher illumination levels.

Comparatively expensive control circuits have also been proposed in which the luminescence of the relevant screen is measured via special photosensors or the current of the tubes is used as a criterion.

The invention has for its object to provide a brightness-dependent power supply for a noctoviser in which the drawback of switching-off is avoided and the costs inherent to the control circuits are substantially reduced.

This problem is solved according to the invention in that the intensifier tube is connected to the high-voltage generator output via a parallel connection of a resistor and an avalanche diode. In multi-stage noctovisers each tube is connected to the high-voltage output of each cascade of the high-voltage generator via such a parallel connection.

One embodiment according to the invention will be described in detail hereinafter with reference to the drawing.

Figure 2:
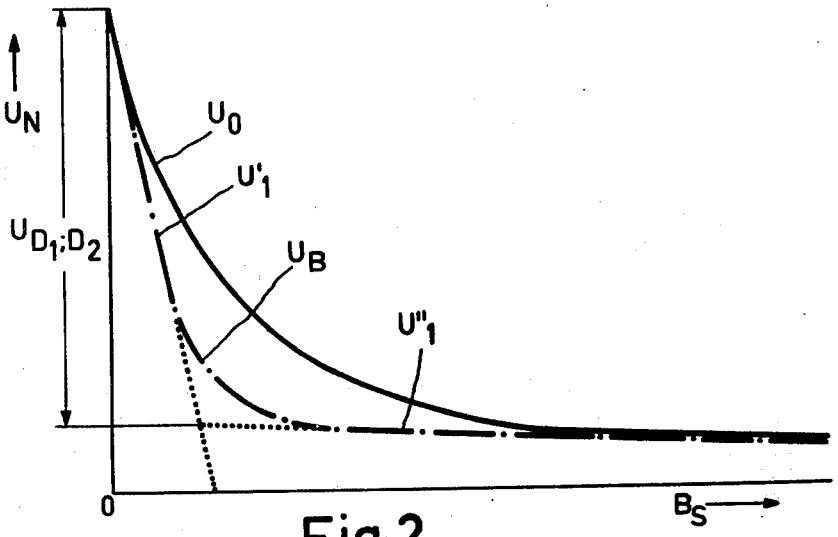

FIG. 1 shows a circuit arrangement of a preferred embodiment according to the invention, and FIG. 2 shows a voltage diagram relating to this preferred embodiment.

One the basis of the fact that for an n-stage arrangement of image intensifier tubes, always also including image-converting tubes, the following formula is applicable for constant luminescence on the last screen:

$$I_1 (B_{scene}) \cdot U^n = K,$$

in which $I_1$ is the current in the first tube,

B is the illumination level on the scene, and

U is the acceleration voltage per tube, so for a two-stage arrangement:

$$I_1 (B_{scene}) \cdot U^2 = K$$

and because $I_1 \sim B_{scene}$, $$U = \sqrt{\frac{K}{B_{scene}}}.$$

As is shown in FIG. 1, each of the outputs of the high-voltage generators 1 and 2 which are successively connected in cascade has connected thereto a parallel connection of a resistor 3 and an avalanche diode 4 (5 and 6, respectively), via which the high voltage reaches the tubes 7 and 8 which are also successively connected. If necessary, a resistor 9, 10 can be connected in series with the diodes 4 and 6, respectively. The desired voltage can be adapted by selection of these resistances. Avalanche diodes are now commercially available in step-wise decreasing values, also between 10 kV . . . 15 kV. The value thereof corresponds to the known housings for high-voltage diodes. In the apparatus the resistors are encapsulated together with the diodes and the cascades used for generating the high voltage.

As appears from the diagram shown in FIG. 2, the theoretically most favourable variation of $U_0$ can be very well approximated. The diagram shows the variation of the high voltage $U_n$ and of the voltage $U_4$, $U_6$ of the two avalanche diodes 4 and 6, respectively, as a function of the illumination level on the scene ($B_{scene}$). The voltage part $U'_1$ is determined by the resistors 3 and 5. $U_B$ represents the transitional region of the avalanche diodes, whilst the voltage part $U''_1$ is determined by the resistors 9 and 10.

What is claimed is:

1. A noctoviser having automatic brightness compensation, comprising:
   - an image intensifier tube;
   - a high-voltage generator for producing a substantially constant high-voltage;
   - a resistor directly connecting said high-voltage generator to said image intensifier tube to reduce the high-voltage delivered to said tube as the tube current increases; and
   - an avalanche diode connected in parallel with said resistor to limit the high-voltage reduction by said resistor in order to prevent said tube from switching-off at very high brightness input levels, said parallel connected resistor and diode effectively varying the high-voltage delivered to said tube such that the output luminescence of said tube remains approximately the same at all brightness input levels.

2. A noctoviser as defined in claim 1 and further comprising a second resistor connected in series with said avalanche diode, said series connected avalanche diode and second resistor being directly connected in parallel with the first resistor.

3. A noctoviser as defined in claim 2 and further comprising a second stage comprising:
   - a second image intensifier tube connected in series with the first image intensifier tube;
   - a second high-voltage generator connected in series with the first high-voltage generator for powering said second image intensifier tube;
   - a third resistor directly connecting said second high-voltage generator to said second image intensifier tube; and
   - a second avalanche diode and a fourth resistor connected in series directly across said third resistor.

* * * * *